US011184694B2

(12) United States Patent
Cheng et al.

(10) Patent No.: US 11,184,694 B2
(45) Date of Patent: Nov. 23, 2021

(54) INTEGRATED MICROPHONE DEVICE AND MANUFACTURING METHOD THEREOF

(71) Applicant: Taiwan Semiconductor Manufacturing Co., Ltd., Hsinchu (TW)

(72) Inventors: Chun-Wen Cheng, Zhubei (TW); Chia-Hua Chu, Zhubei (TW); Chun-Yin Tsai, Hsinchu (TW); Tzu-Heng Wu, New Taipei (TW); Wen-Cheng Kuo, Changhua County (TW)

(73) Assignee: TAIWAN SEMICONDUCTOR MANUFACTURING CO., LTD, Hsinchu (TW)

( * ) Notice: Subject to any disclaimer, the term of this patent is extended or adjusted under 35 U.S.C. 154(b) by 0 days.

(21) Appl. No.: 16/813,923

(22) Filed: Mar. 10, 2020

(65) Prior Publication Data

US 2020/0213701 A1 Jul. 2, 2020

Related U.S. Application Data

(63) Continuation of application No. 15/797,813, filed on Oct. 30, 2017, now Pat. No. 10,609,463.

(51) Int. Cl.

| | |
|---|---|
| ***H04R 1/08*** | (2006.01) |
| ***H04R 19/00*** | (2006.01) |
| ***H04R 19/04*** | (2006.01) |
| ***H04R 31/00*** | (2006.01) |

(52) U.S. Cl.
CPC ..... *H04R 1/08* (2013.01); *H04R 19/005* (2013.01); *H04R 19/04* (2013.01); *H04R 31/00* (2013.01); *H04R 2201/003* (2013.01)

(58) Field of Classification Search
CPC ..... H04R 1/08; H04R 19/005; H04R 19/04; H04R 2201/003; H04R 31/00
See application file for complete search history.

(56) References Cited

U.S. PATENT DOCUMENTS

| | | | |
|---|---|---|---|
| 8,724,841 | B2 | 5/2014 | Bright et al. |
| 9,002,037 | B2 | 4/2015 | Dehe et al. |
| 9,206,031 | B2 | 12/2015 | Jenkins et al. |
| 9,487,389 | B2 | 11/2016 | Jenkins et al. |
| 9,637,374 | B2 | 5/2017 | Jenkins et al. |
| 9,736,590 | B2 | 8/2017 | Klein et al. |
| 9,756,429 | B2 | 9/2017 | Jenkins et al. |
| 9,876,446 | B2 | 1/2018 | Dehe |

(Continued)

FOREIGN PATENT DOCUMENTS

| | | |
|---|---|---|
| KR | 10-2012-0135068 A | 12/2012 |
| KR | 10-2015-0140582 A | 12/2015 |

*Primary Examiner* — Oyesola C Ojo
(74) *Attorney, Agent, or Firm* — McClure, Qualey & Rodack, LLP

(57) ABSTRACT

An integrated microphone device is provided. The integrated microphone device includes a substrate, a plate, and a membrane. The substrate includes an aperture allowing acoustic pressure to pass through. The plate is disposed on a side of the substrate. The membrane is disposed between the substrate and the plate and movable relative to the plate as acoustic pressure strikes the membrane. The membrane includes a vent valve having an open area that is variable in response to a change in acoustic pressure.

20 Claims, 19 Drawing Sheets

(56) References Cited

U.S. PATENT DOCUMENTS

| | | | | |
|---|---|---|---|---|
| 2008/0212409 | A1* | 9/2008 | Lutz | H04R 19/005 367/181 |
| 2011/0165717 | A1 | 7/2011 | Lee et al. | |
| 2012/0250909 | A1* | 10/2012 | Grosh | H04R 7/06 381/174 |
| 2012/0308053 | A1* | 12/2012 | Dehe | H02N 99/00 381/150 |
| 2013/0223654 | A1 | 8/2013 | Dehe et al. | |
| 2014/0161290 | A1* | 6/2014 | Jenkins | H04R 23/006 381/174 |
| 2014/0206123 | A1 | 7/2014 | Chu et al. | |
| 2015/0132880 | A1* | 5/2015 | Hsieh | B81B 3/0013 438/53 |
| 2015/0189444 | A1 | 7/2015 | Pan et al. | |
| 2015/0264464 | A1 | 9/2015 | Okugawa | |
| 2016/0094918 | A1 | 3/2016 | Uchida et al. | |
| 2016/0137486 | A1 | 5/2016 | Bharatan | |
| 2016/0176704 | A1* | 6/2016 | Cargill | H04R 19/04 257/419 |
| 2017/0013363 | A1 | 1/2017 | Berger et al. | |
| 2017/0217761 | A1* | 8/2017 | Chung | B81C 1/00158 |
| 2017/0280218 | A1 | 9/2017 | Wang et al. | |
| 2018/0022603 | A1 | 1/2018 | Chu | |
| 2018/0115836 | A1 | 4/2018 | Hsieh et al. | |
| 2018/0206042 | A1 | 7/2018 | Kursula et al. | |
| 2018/0262843 | A1 | 9/2018 | Barzen | |
| 2018/0273372 | A1* | 9/2018 | Piechocinski | H04R 19/04 |

* cited by examiner

INTEGRATED MICROPHONE DEVICE AND MANUFACTURING METHOD THEREOF

PRIORITY CLAIM AND CROSS-REFERENCE

This application is a Continuation of application Ser. No. 15/797,813, filed on Oct. 30, 2017, now U.S. Pat. No. 10,609,463 the entirety of which is incorporated by reference herein.

BACKGROUND

The current tendency is toward fabricating slim, compact, lightweight and high-performance electronic devices, including microphones. A microphone is used to receive sound waves and convert acoustic signals into electric signals. Microphones are widely used in daily life and are installed in such electronic products as telephones, mobiles phones, and recording pens. In a capacitive microphone, variation of acoustic pressure (i.e. local pressure deviation from the ambient atmospheric pressure caused by the sound waves) forces the diaphragm to deform correspondingly, and the deformation of the diaphragm induces a capacitance variation. The variation of acoustic pressure can thus be obtained via detecting the voltage difference caused by the capacitance variation.

This is distinct from the conventional electret condenser microphones (ECM), in which mechanical and electronic elements of micro electro-mechanical system (MEMS) microphones can be integrated on a semiconductor material using integrated circuit (IC) technology to fabricate a miniaturized microphone. MEMS microphones have advantages such as a compact size, being lightweight, and having low power consumption, and they have therefore entered the mainstream of miniaturized microphones. Furthermore, MEMS microphones can be easily integrated with a complementary metal-oxide-semiconductor (CMOS) process and other audio electronic devices.

Although existing microphone devices have generally been adequate for their intended purposes, they have not been entirely satisfactory in all respects.

BRIEF DESCRIPTION OF THE DRAWINGS

For a more complete understanding of the present disclosure, and the advantages of the present disclosure, reference is now made to the following descriptions taken in conjunction with the accompanying drawings, in which:

FIG. 5H-1 is a top view of the vent valve, in accordance with some embodiments.

DETAILED DESCRIPTION

Figure 1:
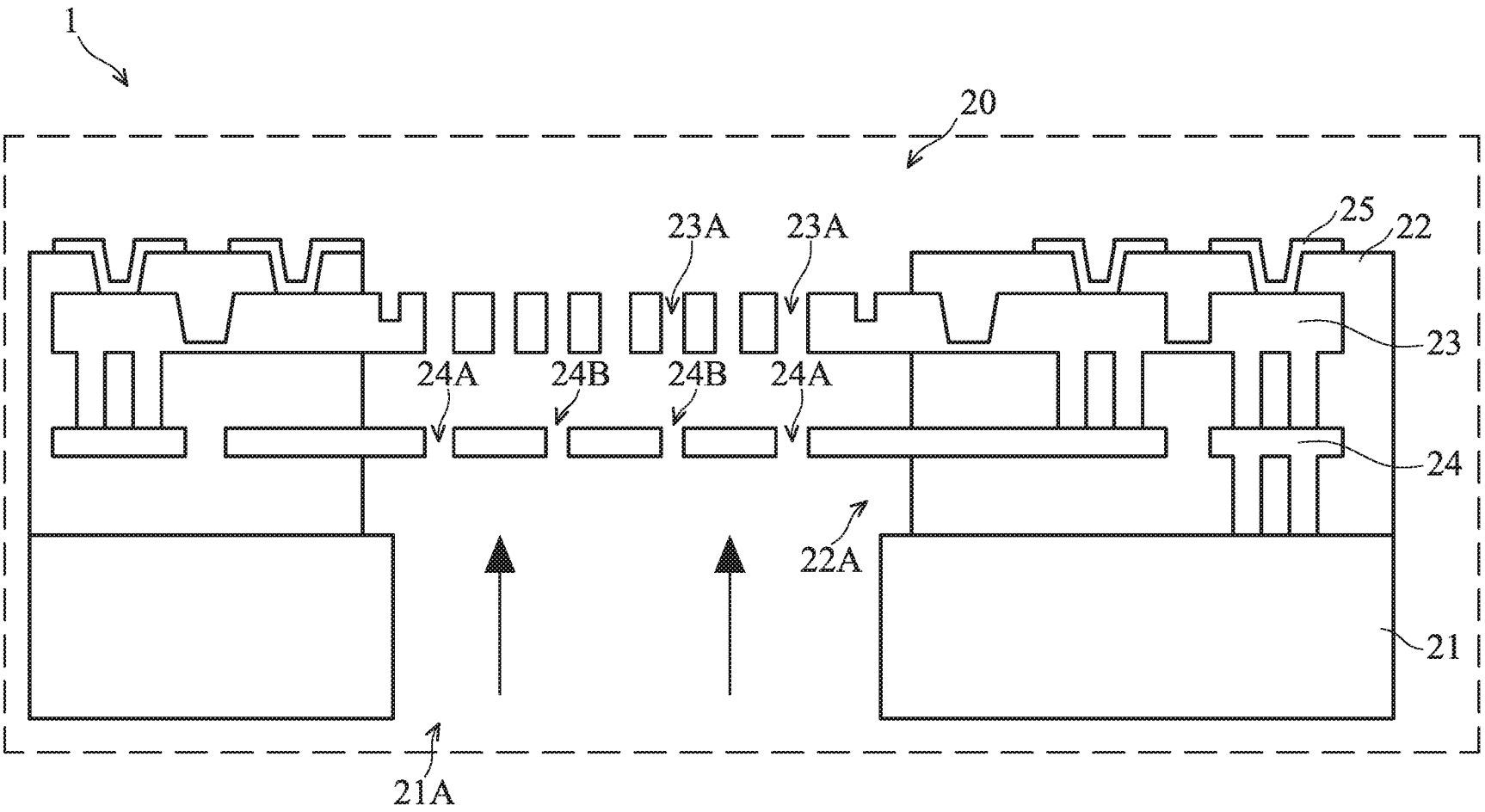
FIG. 1 is a schematic diagram of an integrated microphone device, in accordance with some embodiments.

The following disclosure provides many different embodiments, or examples, for implementing different features of the invention. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed. Various features may be arbitrarily drawn in different scales for the sake of simplicity and clarity.

Furthermore, spatially relative terms, such as "beneath," "below," "lower," "above," "upper" and the like, may be used herein for ease of description to describe one element or feature's relationship to another element(s) or feature(s)

as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

In the present disclosure, an integrated microphone device for sense acoustic pressure is provided in accordance with various exemplary embodiments. The variations of some embodiments are discussed. Throughout the various views and illustrative embodiments, like reference numbers are used to designate like elements.

FIG. 1 is a schematic diagram of an integrated microphone device 1, in accordance with some embodiments. The integrated microphone device 1 includes a MEMS structure 20 including a capacitive microphone. The integrated microphone device 1 is configured to sense acoustic pressure (as the arrows indicated in FIG. 1). The acoustic pressure is received by the MEMS structure 20 and then is converted from acoustic signals into electric signals. The integrated microphone device 1 may include a housing, depicted in a dotted line, enclosing the MEMS structure 20. The housing may have some apertures so as to provide channels for the MEMS structure 20 communicating with ambient environment external to the housing. Although not shown, in actual use, the integrated microphone device 1 can be further mounted on a circuit board of an electronic product via a surface-mount (SMT) method.

The MEMS structure 20 includes a substrate 21, a dielectric layer 22, a plate 23, a membrane 24, and a conductive layer 25. It should be noted that the MEMS structure 20 in FIG. 1 has been simplified for the sake of clarity to better understand the inventive concepts of the present disclosure. Additional features can be added into the MEMS structure 20, and some of the features described below can be replaced or eliminated in other embodiments of the MEMS structure 20.

The substrate 21 is configured to support the dielectric layer 22, plate 23, membrane 24 and conductive layer 25 on a side thereof. The substrate 21 includes an aperture 21A which allows the acoustic pressure received by the MEMS structure 20 to pass through and enter the MEMS structure 20. In some embodiments, the substrate 21 is made of silicon or the like.

The dielectric layer 22 is disposed between the substrate 21 and membrane 24, between the membrane 24 and plate 23, and between the plate 23 and conductive layer 25, so as to provide partial isolation between the substrate 21, membrane 24, plate 23 and conductive layer 25 from each other. In some embodiments, the dielectric layer 22 is disposed around the plate 23 and membrane 24, such that the plate 23 and membrane 24 are clamped at their edges by the dielectric layer 22. In some embodiments, the dielectric layer 22 includes an aperture 22A corresponding to the aperture 21A of substrate 21, to allow the acoustic pressure to pass through the plate 23 and membrane 24 and then leave the MEMS structure 20. In some embodiments, the dielectric layer 22 is made of silicon oxide or the like.

The plate 23 and membrane 24 form a capacitive microphone of the MEMS structure 20. The plate 23 is a stationary element and serves as a back plate of the MEMS structure 20 (that is, the MEMS structure 20 in FIG. 1 is upside down in actual use and the plate 23 is located at the back side). In some embodiments, the plate 23 is in circular, rectangular, quadrilateral, triangular, hexagonal, or any other suitable shape. In some embodiments, the plate 23 has sufficient stiffness such that it would not be bent or movable when the acoustic pressure passes through the plate 23. In some embodiments, the plate 23 has a thickness of about 0.5 μm to about 2 μm. In some embodiments, the plate 23 is in the form of a nitride/poly-silicon/nitride stacks to enhance its stiffness.

In some embodiment, the plate 23 is doped with suitable dopants to have better conductivity. For example, the plate 23 is doped with a p-type dopant such as boron or an n-type dopant such as phosphorous.

The plate 23 is a stiff perforated element. As shown in FIG. 1, the plate 23 includes several vent holes 23A each passing through the plate 23. The vent holes 23A are configured to allow the acoustic pressure to pass through, such that the vent holes 23A can withstand the stress on the plate 23 caused by acoustic pressure and the plate 23 would not be bent by the acoustic pressure. In some embodiments, the vent holes 23A are arranged in a regular array or an irregular array over the plate 23. In some embodiments, each vent hole 23A is in circular, quadrilateral, elliptical, triangular, hexagonal, or any other suitable shape. In some embodiments, a total number of the vent holes 23A, the pitch between adjacent vent holes 23A or/and the width of each vent hole 23A is predetermined and designed, so that the plate 23 has sufficient stiffness to resist the acoustic pressure striking thereon. In some embodiments, an open area of the vent holes 23A over the plate 23 is chosen, for example, about 40 percent to about 60 percent of the (surface) area of the plate 23, to have sufficient stiffness to prevent unwanted deflection of the plate 23 or device SNR (signal-to-noise ratio) loss.

The membrane 24 is disposed opposite to and electrically connected to the plate 23. In some embodiments, the membrane 24 is disposed between the plate 23 and the aperture 21A of substrate 21. In some embodiments, the membrane 24 is disposed away from the plate 23 at a distance of about 1 μm to about 5 μm. In some embodiments, the membrane 24 is in circular, rectangular, quadrilateral, triangular, hexagonal, or any other suitable shape. In some embodiments, the membrane 24 has a thickness of about 0.1 μm to about 5 μm.

The membrane 24 is conductive and capacitive. In some embodiments, the membrane 24 is made of poly-silicon or the like. In some embodiments, the membrane 24 is doped with suitable dopants, such as boron or phosphorous, to have better conductivity. In some embodiments, the membrane 24 is supplied with a predetermined charge via a conductive layer 25 disposed on the plate 23. In some embodiments, the MEMS structure 20 is electrically connected to a circuit board of an electronic product via several conductive pads of the conductive layer 25. In some embodiments, the conductive layer 25 comprises copper, silver, gold, aluminum, or alloy thereof.

The membrane 24 is a movable or oscillatable element. The membrane 24 is displaceable relative to the plate 23 and serves as a diaphragm of the MEMS structure 20. The membrane 24 is configured to sense the acoustic pressure received by the MEMS structure 20. When the acoustic pressure strikes the membrane 24, the membrane 24 would be displaced or oscillated in response to the acoustic pressure impinged on the membrane. In some embodiments, a magnitude and/or a frequency of the displacement of the membrane 24 corresponds to a volume and/or a pitch of the acoustic pressure impinged on the membrane 24.

In some embodiments, the displacement of the membrane 24 relative to the plate 23 causes a capacitance change between the membrane 24 and plate 23. The capacitance change is then converted into an electric signal by a circuitry connected with the plate 23 and membrane 24. The electric signal represents the acoustic pressure impinged on the membrane 24. In some embodiments, the generated electric signal is transmitted, via the conductive layer 25, to another device, another substrate or another circuitry for further processing. In some embodiments, the substrate 21 is electrically grounded via a conductive route formed by the membrane 24, plate 23 and conductive layer 25.

In some embodiments, the membrane 24 includes several vent holes 24A over the membrane 24, so as to relieve the stress on the membrane 24 caused by acoustic pressure. In some embodiments, the vent holes 24A are substantially aligned with the vent holes 23A of plate 23 to allow the acoustic pressure to pass through membrane 24 and plate 23. In some embodiments, each vent hole 24A is in circular, quadrilateral, elliptical, triangular, hexagonal, or any other suitable shape. In some embodiments, a total number of the vent holes 24A, the pitch between adjacent vent holes 24A or/and the width of each vent hole 24A is predetermined and designed, so that the membrane 24 would not have unwanted bending or device SNR loss. In some embodiments, a total number of the vent holes 24A over the membrane 24 is less than a total number of the vent holes 23A over the plate 23. In some embodiments, an open area of the vent holes 24A over the membrane 24 is chosen, for example, less than 20 percent of the (surface) area of the membrane 24, to optimize the straightness and the sensitivity of the membrane 24. The membrane 24 can sense the acoustic pressure accurately and promptly, and can be returned to the initial straight configuration after sensing the acoustic pressure.

It should be noted that the membrane 24 may be easily damaged when a large acoustic pressure (for example, greater than about 0.2 MPa) is exerted thereon. To prevent damage to the membrane, the rigidity of the membrane 24 may be increased (for example, increasing the thickness of the membrane 24), or an open area of the vent holes 24A over the membrane 24 may be increased (for example, increasing the hole size and/or the amount of vent holes 24A). However, increased thickness or open ratio in the membrane may adversely affect the sensitivity of the microphone device.

In order to prevent the membrane 24 from being easily broken while maintaining the performance of the integrated microphone device 1, the MEMS structure 20 shown in FIG. 1 uses vent valves 24B to replace some vent holes 24A of the membrane 24. In some alternative exemplary embodiments, all the vent holes 24A of the membrane 24 are replaced by the vent valves 24B. The vent valves 24B can achieve high open area/ratio of the membrane 24 in case of a large acoustic pressure for releasing the acoustic pressure and keep low open area/ratio of the membrane 24 in case of a low acoustic pressure for keeping high sensitivity of the membrane 24.

Each vent valve 24B has an open area that is variable in response to a change in acoustic pressure, which will be illustrated later. In some embodiments, the sum of an initial open area of the vent valves 24B and an open area of the vent holes 24A over the membrane 24, or an initial open area of the vent valves 24B over the membrane 24 (in a case of no vent hole 24A is formed in the membrane 24), is less than 20 percent of the (surface) area of the membrane 24, to optimize the straightness and the sensitivity of the membrane 24. In some embodiments, the greater the acoustic pressure, the greater the open area of the vent valves 24B (that is, the vent valves 24B may have a first open area in response to a first acoustic pressure and a second open area in response to a second acoustic pressure, wherein the second acoustic pressure is greater than the first acoustic pressure and the second open area is greater than the first open area), to allow the acoustic pressure to pass through the membrane 24.

Figure 2:
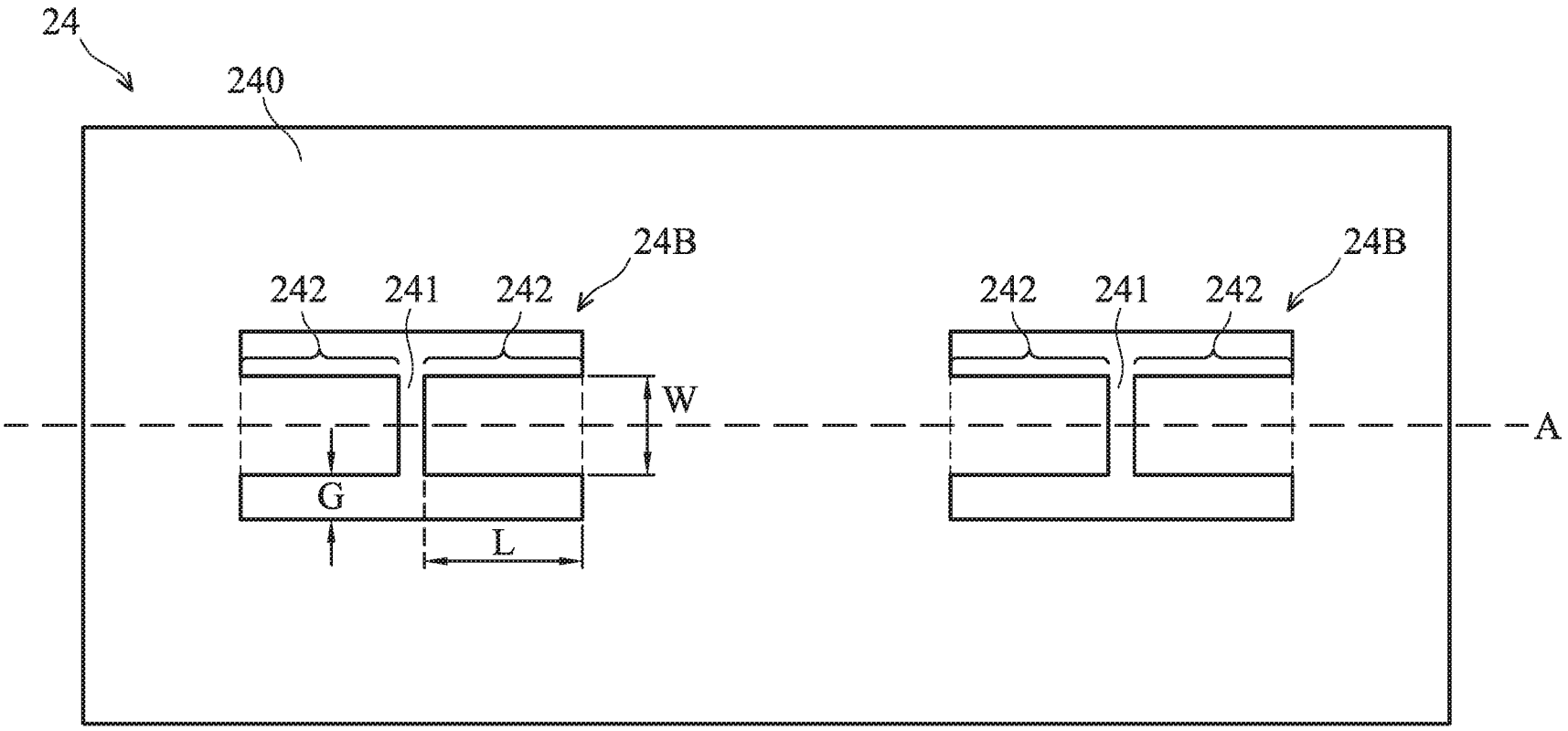
FIG. 2 is a top view of vent valves formed in the membrane of FIG. 1, in accordance with some embodiments.

FIG. 2 is a top view of the vent valves 24B formed in the membrane 24 of FIG. 1, in accordance with some embodiments. The shape/pattern of the vent valve 24B is different from that of the vent hole 24A. Each vent valve 24B has an opening 241 and at least one deflection part 242 covering a portion of the opening 241 (note that the vent hole 24A has an opening but no deflection part formed thereon). In some embodiments, the at least one deflection part 242 extends from the main body 240 of the membrane 24 and is adjacent to the opening 241. In some embodiments, the at least one deflection part 242 is a beam element with one end connected to the main body 240 of the membrane 24.

In the embodiments of FIG. 2, each vent valve 24B includes two deflection parts 242 (beam elements) disposed opposite to each other (that is, arranged along a straight line A). The opening 241 is disposed between the deflection parts 242 and between the deflection parts 242 and main body 240 (i.e. the opening 241 is disposed around the deflection parts 242). In some embodiments, the length L of the deflection part 242 is between about 1 μm to about 100 μm, the width W of the deflection part 242 is between about 1 μm to about 100 μm, and the (initial) width G of the opening 241 is between about 1 μm to about 5 μm.

Figure 3:
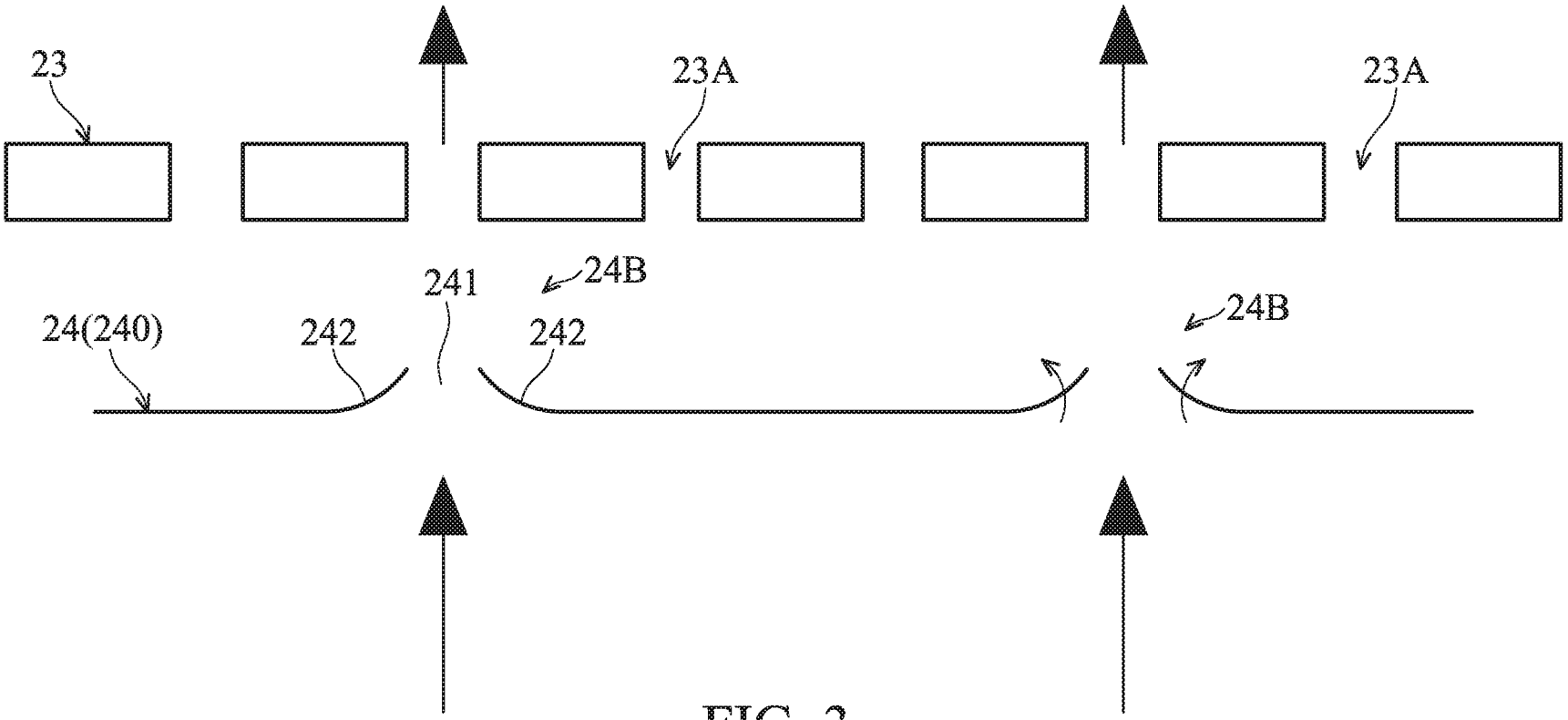
FIG. 3 schematically illustrates that the vent valves can change or increase an open area thereof to allow a large acoustic pressure to pass therethrough.

In some embodiments, the deflection part or mechanisms 242 of the vent valve 24B are deflectable relative to the main body 240 of the membrane 24, in response to a change in the acoustic pressure impinging on the membrane 24, to change an open area of the opening 241 (i.e. an open area of the vent valve 24B). In some embodiments, the greater the deflection of the deflection part or mechanisms 242, the greater the open area of the opening 241 (that is, the opening 241 may have a first open area in response to a first deflection of the deflection parts 242 and a second open area in response to a second deflection of the deflection parts 242, wherein the second deflection is greater than the first deflection and the second open area is greater than the first open area), such that a large acoustic pressure can pass through the membrane 24. For example, when a low acoustic pressure (for example, less than about 0.2 MPa) strikes the membrane 24, the mechanisms 242 of vent valve 24B may be deflected relative to the main body 240 of the membrane 24 by about 0.1 μm or less than 0.1 μm (in this state, the initial open area/ratio of the openings 241 is almost maintained), to allow the (low) acoustic pressure to pass through the membrane 24. When a large acoustic pressure (for example, greater than about 0.2 MPa) strikes the membrane 24, the mechanisms 242 of vent valve 24B may be deflected relative to the main body 240 by about 0.5 μm or greater than 0.5 μm, to increase the open area/ratio of the openings 241 and allow the (large) acoustic pressure to pass through the membrane 24, as shown in FIG. 3. The vent valves 24B can then be returned to the initial straight configuration after the acoustic pressure passes through the membrane 24 (as shown in FIG. 1).

Accordingly, the broken issue of the membrane 24 is solved and the sensitivity of the membrane 24 is also maintained. As a result, the reliability and the availability of the integrated microphone device 1 are increased.

Figure 4:
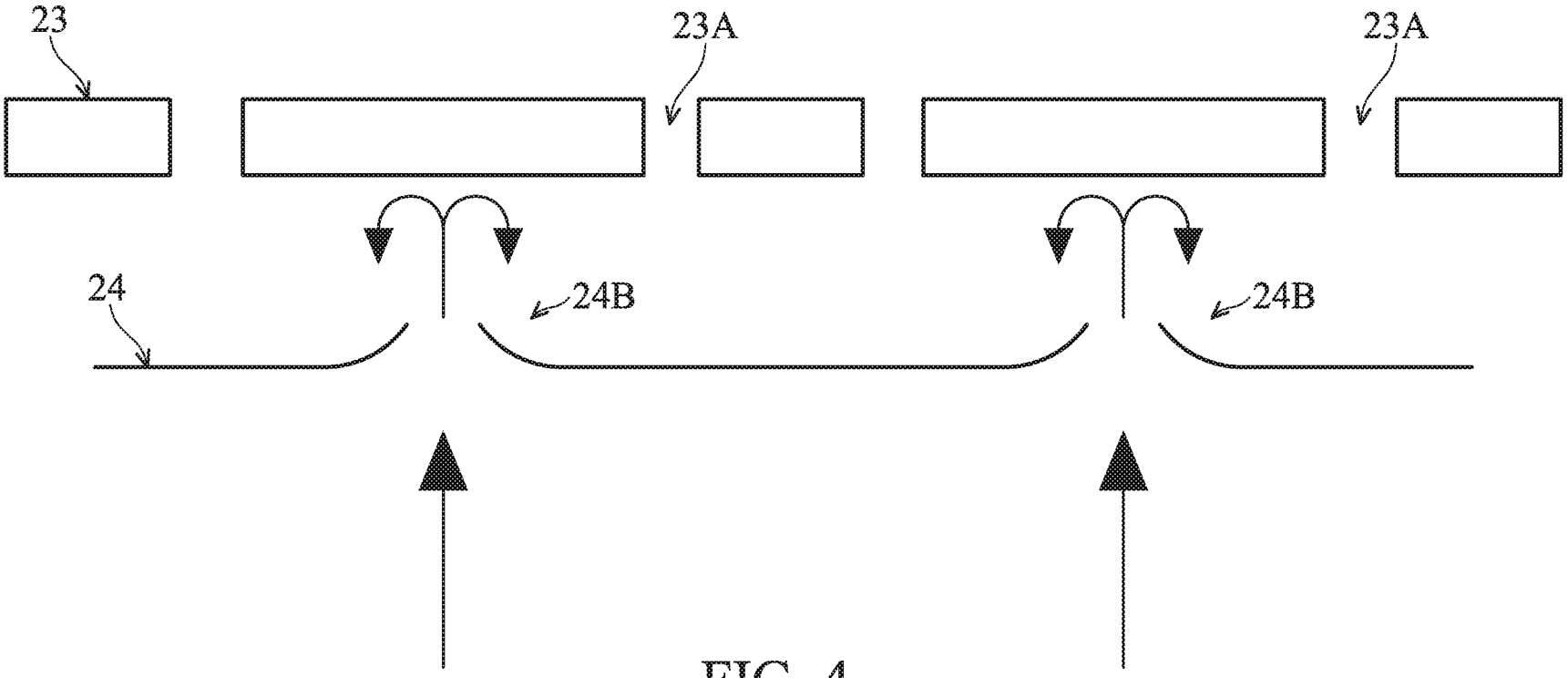
FIG. 4 schematically illustrates that the vent valves are not aligned with the vent holes of the plate, in accordance with some embodiments.

In some embodiments, the vent valves 24B of the membrane 24 are substantially aligned or not aligned with the vent holes 23A of plate 23. It should be noted that the vent valves 24B may not be aligned with the vent holes 23A, and the acoustic pressure reflected from the solid part of the plate 23 would still not interference with the activity of the vent valves 24B which has automatic adjustment ability for the acoustic pressure, as shown in FIG. 4.

It should be appreciated that many variations and modifications can be made to embodiments of the present disclosure. For example, the vent valve 24B of the membrane 24 may also have various other shapes/patterns as described below.

Figure 5B:
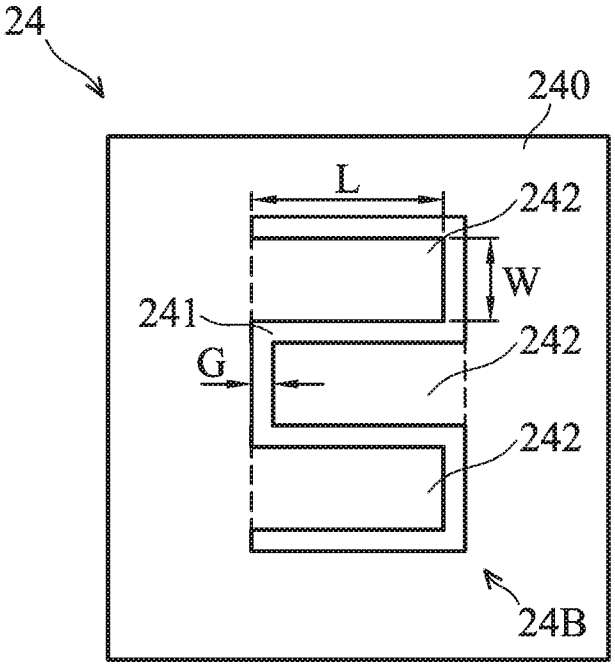
FIG. 5B is a top view of the vent valve, in accordance with some embodiments.
Figure 5A:
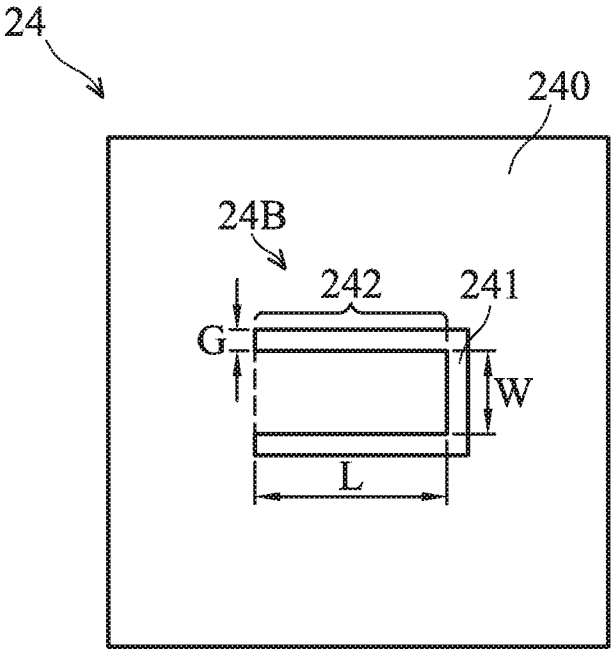
FIG. 5A is a top view of the vent valve, in accordance with some embodiments.

FIG. 5A is a top view of the vent valve 24B, in accordance with some embodiments. The vent valve 24B has an opening 241 and a deflection part 242 (beam element) with one end connected to the main body 240 of the membrane 24. The opening 241 is disposed around the deflection part 242 to have a U-shape. FIG. 5B is a top view of the vent valve 24B, in accordance with some embodiments. The vent valve 24B includes an opening 241 and three deflection parts 242 (beam elements) each with one end connected to the main body 240 of the membrane 24. The deflection parts 242 are arranged in a staggered manner. The opening 241 is disposed around the deflection part 242 to have a zigzag-shape. In some embodiments, the sizes of the deflection part 242 and opening 241 in FIGS. 5A and 5B are similar to those in FIG. 2 described above. In some embodiments, the number of the deflection parts 242 of vent valve 24B may be two or more than three.

Figure 5D:
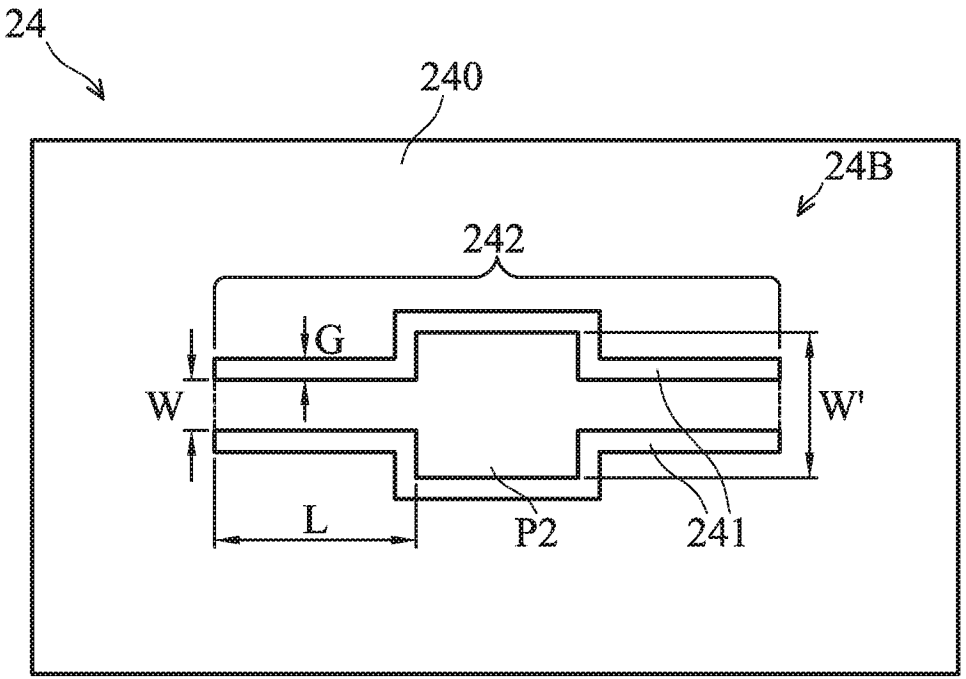
FIG. 5D is a top view of the vent valve, in accordance with some embodiments.
Figure 5C:
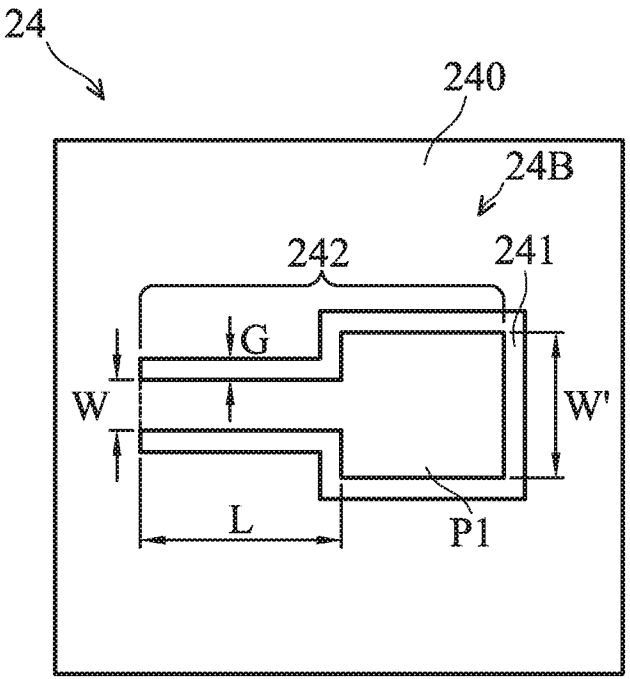
FIG. 5C is a top view of the vent valve, in accordance with some embodiments.

FIG. 5C is a top view of the vent valve 24B, in accordance with some embodiments. The vent valve 24B has an opening 241 and a deflection part 242 (beam element) with one end connected to the main body 240 of the membrane 24. A free end portion P1 of the deflection part 242 has a greater width W' (for example, between about 1 μm to about 100 μm) than other portions of the beam element. In some embodiments, the free end portion P1 of the deflection part 242 is rectangular, quadrilateral, circular, hexagonal, or any other suitable shape. In some embodiments, the opening 241 is disposed around the deflection part 242, such that the shape of the opening 241 conforms to the shape of the deflection part 242. FIG. 5D is a top view of the vent valve 24B, in accordance with some embodiments. The vent valve 24B has two openings 241 and a deflection part 242 (beam element) with both ends connected to the main body 240 of the membrane 24. A middle portion P2 of the beam element has a greater width W' (for example, between about 1 μm to about 100 μm) than other portions of the beam element. In some embodiments, the middle portion P2 of the deflection part 242 is rectangular, quadrilateral, circular, hexagonal, or any other suitable shape. The openings 241 are disposed around two opposite sides of the deflection part 242.

Figure 5G:
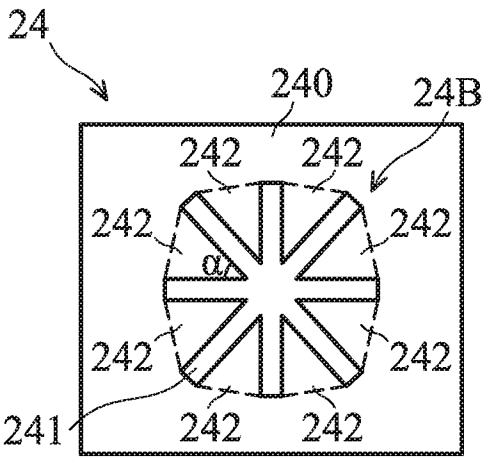
FIG. 5G is a top view of the vent valve, in accordance with some embodiments.
Figure 5F:
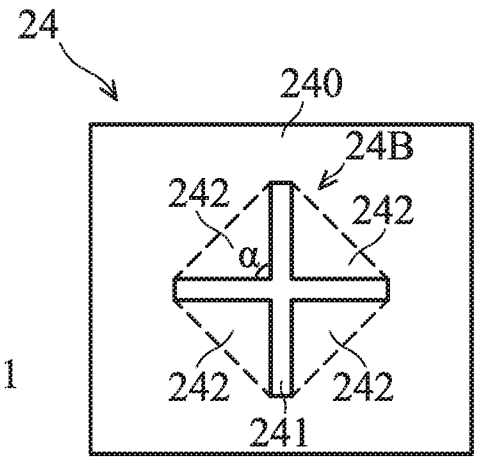
FIG. 5F is a top view of the vent valve, in accordance with some embodiments.
Figure 5E:
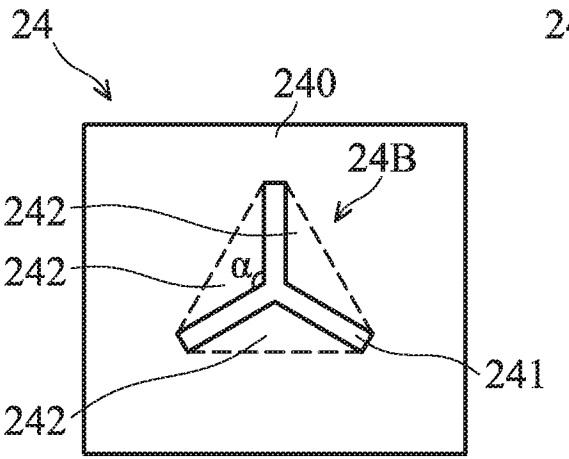
FIG. 5E is a top view of the vent valve, in accordance with some embodiments.

FIGS. 5E to 5G, respectively, are a top view of the vent valve 24B, in accordance with some embodiments. The respective vent valve 24B in FIG. 5E, 5F or 5G has several deflection parts 242 in a triangular shape. Each triangular deflection part 242 has a side connected to the main body 240 of the membrane 24, and an opening 241 of the vent valve 24B is disposed around the other two sides of the respective deflection part 242. In some embodiments, a corner a of the respective triangular deflection part 242 opposite to the side connected to the main body 240 is an obtuse angle, a right angle or an acute angle. The shape of the opening 241 conforms to the shape of the deflection parts 242.

Figure 5I:
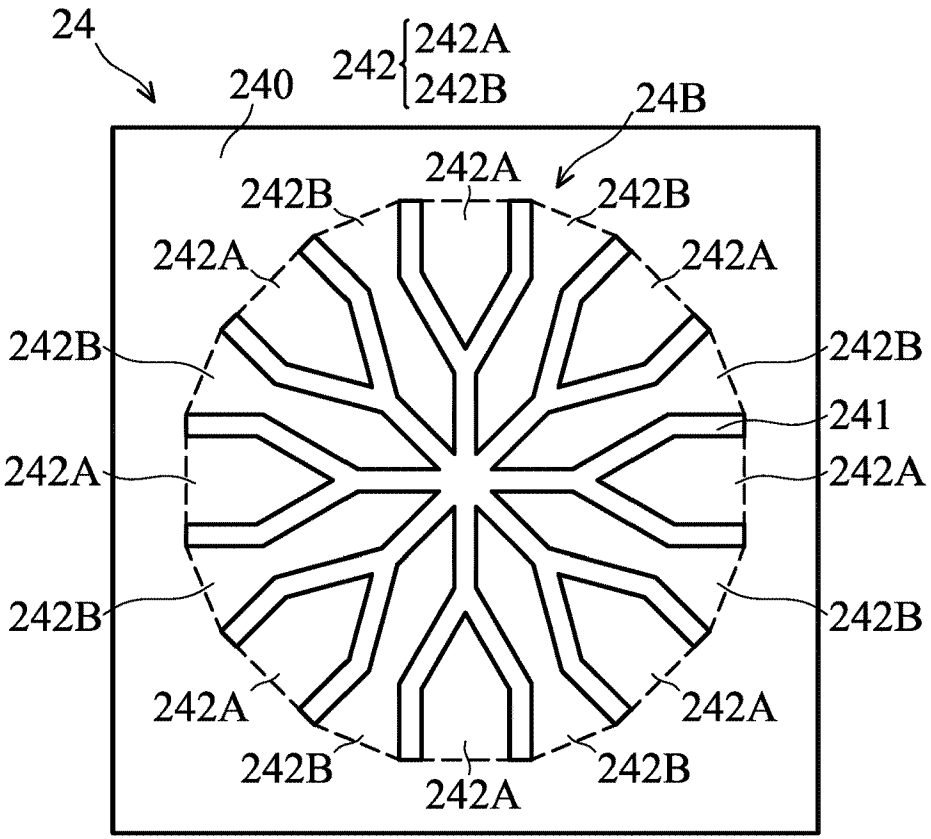
FIG. 5I is a top view of the vent valve, in accordance with some embodiments.
Figure 5H:
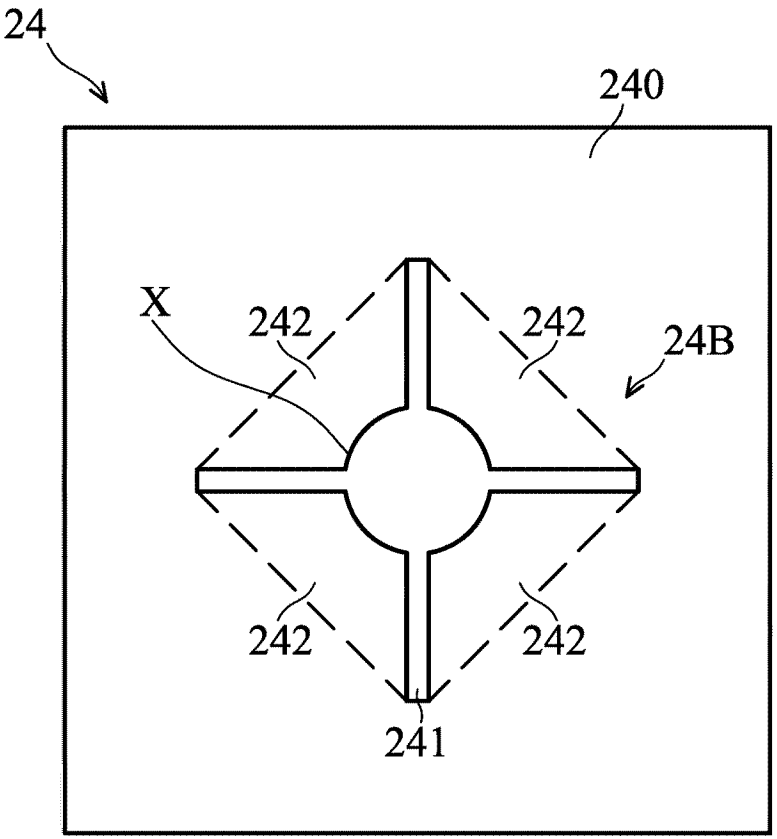
FIG. 5H is a top view of the vent valve, in accordance with some embodiments.
Figures 1, 5H:
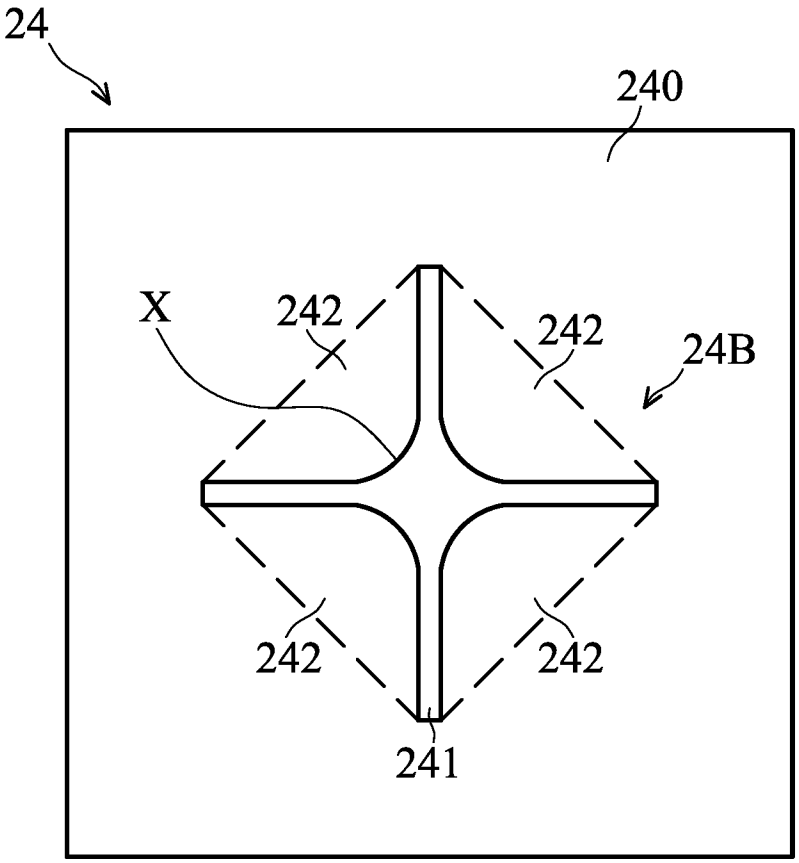

FIG. 5H is a top view of the vent valve 24B, in accordance with some embodiments. The vent valve 24B includes several deflection parts 242 in the shape of a trapezoid. Each trapezoidal deflection part 242 has a side connected to the main body 240 of the membrane 24, and an opening 241 of the vent valve 24B is disposed around the other three sides of the respective deflection part 242. In some embodiments, a side X of the respective deflection part 242 opposite to the side connected to the main body 240 is a concave curved line (as shown in FIG. 5H), a convex curved line (as shown in FIG. 5H-1), or a straight line. The shape of the opening 241 conforms to the shape of the deflection parts 242.

FIG. 5I is a top view of the vent valve 24B, in accordance with some embodiments. The vent valve 24B includes several deflection parts 242 in a sharp-cone shape. Each deflection part 242 has a side connected to the main body 240 of the membrane 24, and an opening 241 of the vent valve 24B is disposed around the other sides of the respective deflection part 242. In some embodiments, the deflection parts 242 further comprise several first deflection parts 242A and several second deflection parts 242B, with different sizes and/or shapes (as shown in FIG. 5I). The shape of the opening 241 conforms to the shape of the deflection parts 242. In operation, when a low acoustic pressure strikes the membrane 24, the first deflection parts 242A (with smaller size) may be deflected relative to the main body 240 while the second deflection parts 242B are not deflected. When a large acoustic pressure strikes the membrane 24, both the first deflection parts 242A and second deflection parts 242B (with larger size) may be deflected relative to the main body 240.

Figure 6:
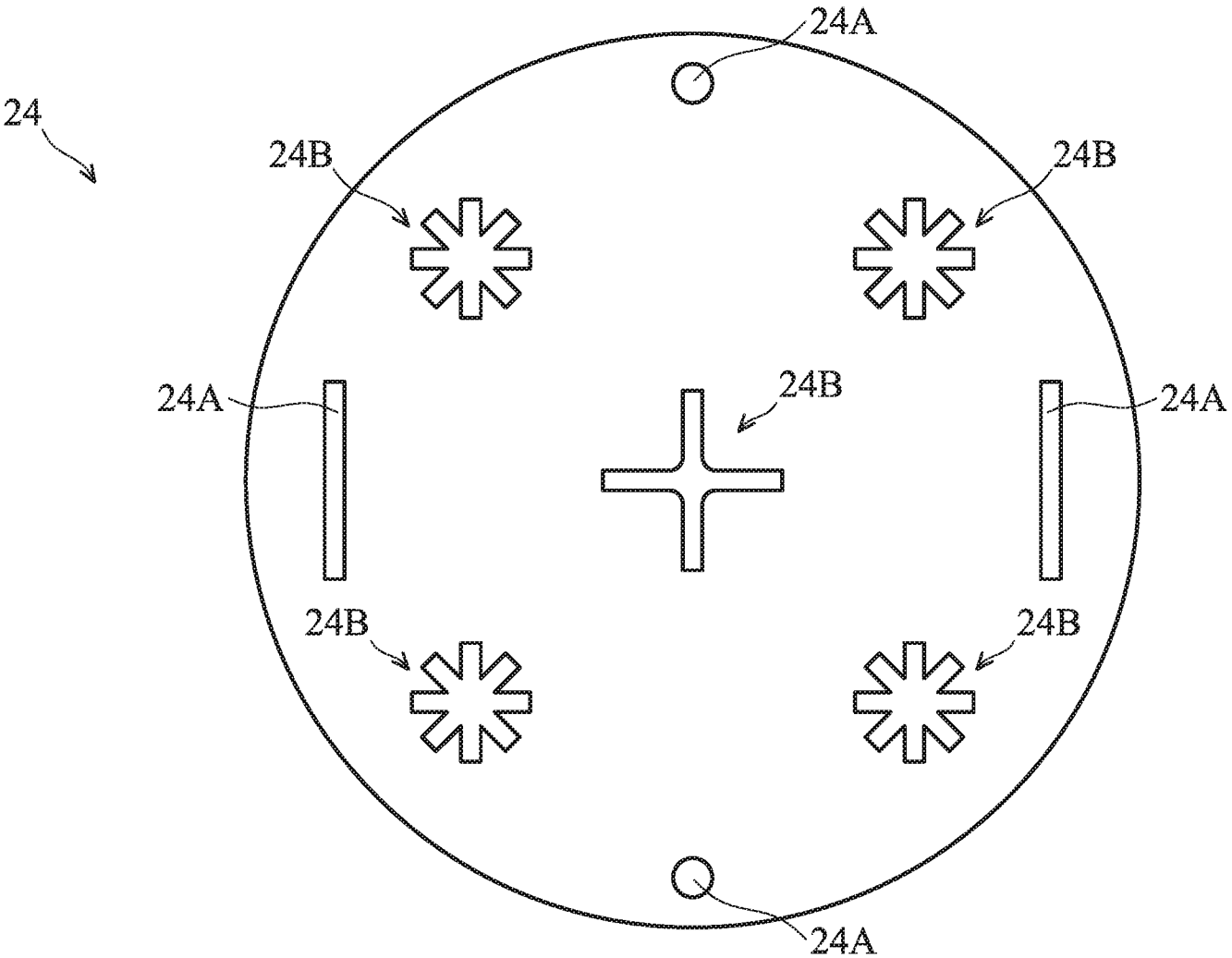
FIG. 6 is a top view of the membrane, in accordance with some embodiments.

In some embodiments, vent valves 24B with different shapes/patterns and vent hole 24A with different shapes/patterns may be formed in the membrane 24, as shown in FIG. 6. In some embodiments, the vent valves 24B are arranged closer to the center of the membrane 24 than the vent holes 24A, so as to better relieve unwanted stress on the membrane 24 caused by acoustic pressure. The vent valves 24B can self-adjust the open area in response to a change in acoustic pressure, thereby allowing a large acoustic pressure to rapidly pass through the membrane 24. Consequently, it is possible to prevent the membrane 24 from being easily broken caused by the (large) acoustic pressure.

Figure 7:
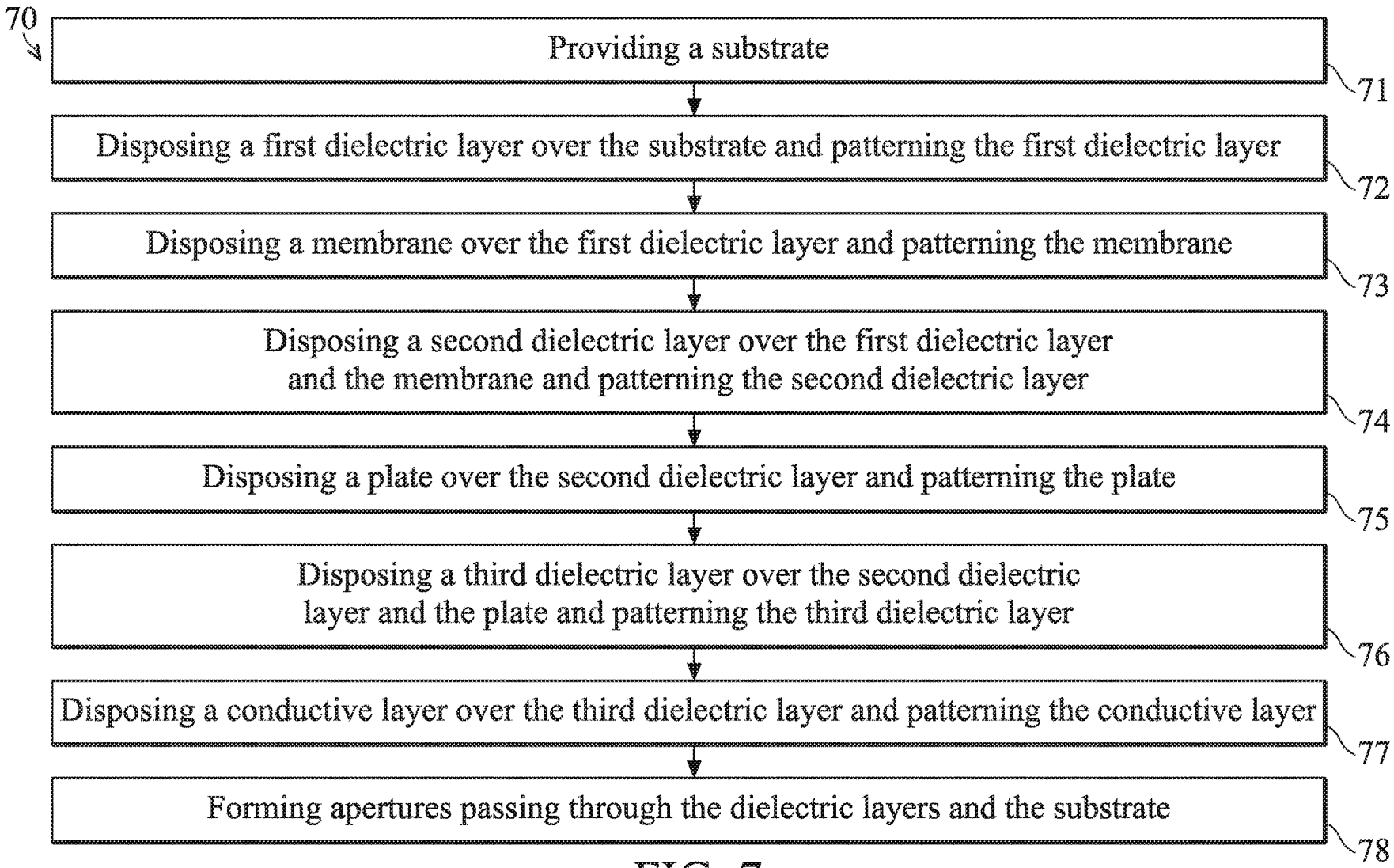
FIG. 7 is a simplified flow chart of a method of manufacturing an integrated microphone device, in accordance with some embodiments.

In the present disclosure, a method of manufacturing an integrated microphone device like the device 1 of FIG. 1 is also disclosed. The method includes a number of operations and the description and illustration are not deemed as limitation as the sequence of the operations. FIG. 7 is a simplified flow chart of a method 70 of manufacturing a portion of the integrated microphone device 1, in accordance with some embodiments. The method 70 includes a number of operations (71, 72, 73, 74, 75, 76, 77, and 78).

Figure 8A:
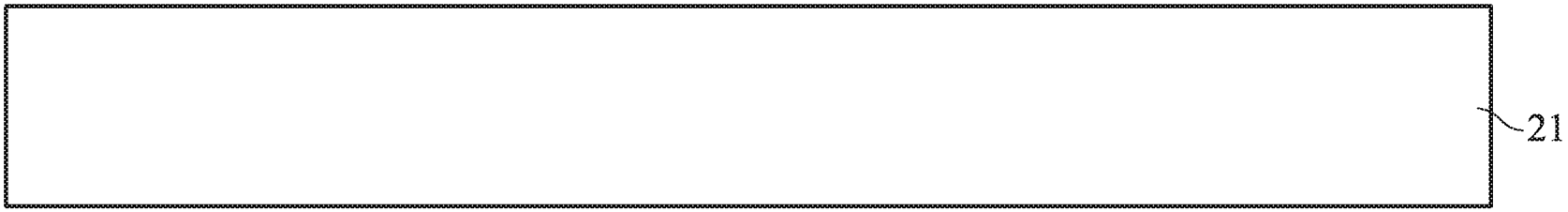
FIG. 8A schematically illustrates an intermediate stage of a method of manufacturing an integrated microphone device, in accordance with some embodiments.

In operation 71, a substrate 21 is provided as shown in FIG. 8A. In some embodiments, the substrate 21 comprises silicon (for example, a silicon wafer). In some embodiments, the substrate 21 has a thickness of about 400 μm to about 1000 μm.

Figure 8B:
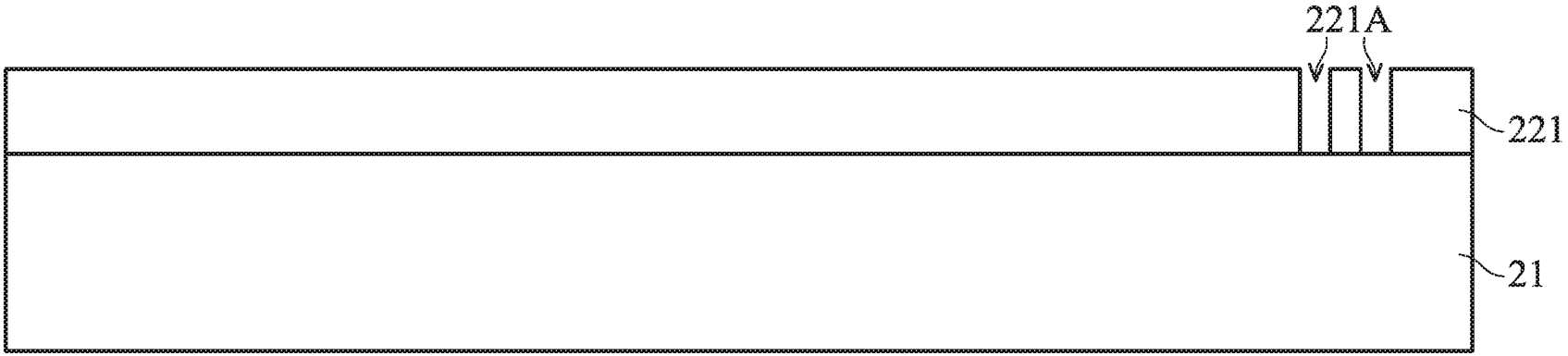
FIG. 8B schematically illustrates an intermediate stage of a method of manufacturing an integrated microphone device, in accordance with some embodiments.

In operation 72, a first dielectric layer 221 is disposed over the substrate 21 as shown in FIG. 8B. In some embodiments, the first dielectric layer 221 is disposed by any suitable deposition techniques such as chemical vapor deposition (CVD) and the like. In some embodiments, the first dielectric layer 221 comprises a dielectric material such as silicon oxide. In some embodiments, the first dielectric layer 221 has a thickness of about 5 μm to about 25 μm. Some portions of the first dielectric layer 221 are then removed to form several opening 221A (i.e. the first dielectric layer 221 is patterned). The openings 221A are through holes which expose a portion of the substrate 21 below the first dielectric layer 221. In some embodiments, the openings 221A are formed by photolithography and wet or dry etching processes.

Figure 8C:
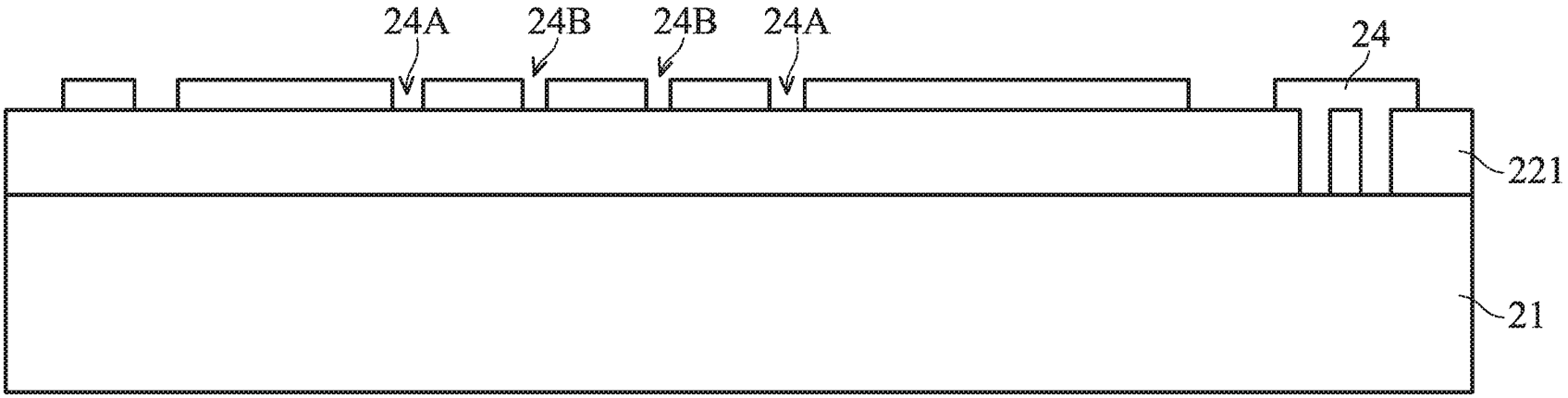
FIG. 8C schematically illustrates an intermediate stage of a method of manufacturing an integrated microphone device, in accordance with some embodiments.

In operation 73, a membrane 24 is disposed over the first dielectric layer 221 as shown in FIG. 8C. The membrane 24 is also filled into the openings 221A (FIG. 8B) of the first dielectric layer 221 to connect the substrate 21. In some embodiments, the membrane 24 comprises conductively doped poly-silicon. In some embodiments, the membrane 24 is disposed by any suitable deposition techniques such as CVD and the like. In some embodiments, the membrane 24 has a thickness of about 0.1 μm to about 5 μm. Some portions of the membrane 24 are then removed to form the vent holes 24A and the vent valves 24B described above (i.e. the membrane 24 is patterned). In particular, each vent valve 24B include an opening 241 and at least one deflection part 242 formed in the opening 241, as shown in FIG. 2 and FIGS. 5A to 5I. The vent holes 24A and vent valves 24B expose a portion of the first dielectric layer 221 below the membrane 24. In some embodiments, the vent holes 24A and vent valves 24B are formed by photolithography and wet or dry etching processes.

Figure 8D:
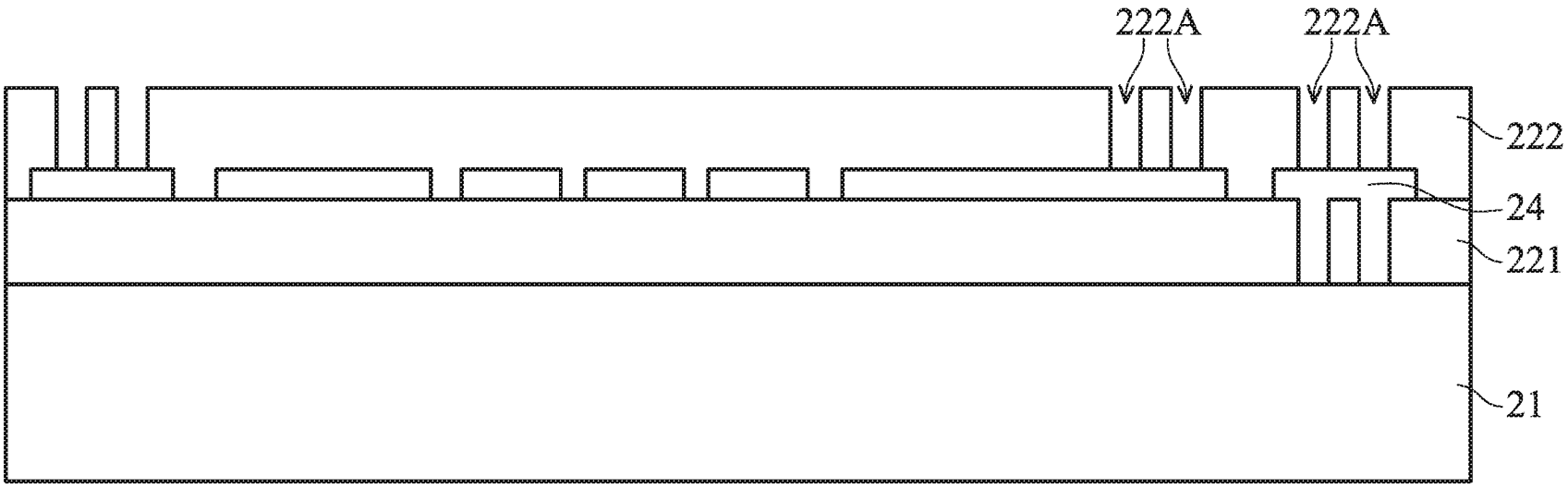
FIG. 8D schematically illustrates an intermediate stage of a method of manufacturing an integrated microphone device, in accordance with some embodiments.

In operation 74, a second dielectric layer 222 is disposed over the first dielectric layer 221 and membrane 24 as shown in FIG. 8D. In some embodiments, the second dielectric layer 222 is disposed by any suitable deposition techniques such as CVD and the like. In some embodiments, the second dielectric layer 222 comprises the same or different materials as the first dielectric layer 221. In some embodiments, the second dielectric layer 222 comprises dielectric material such as silicon oxide. In some embodiments, the second dielectric layer 222 has a thickness of about 1 μm to about 5 μm. Some portions of the second dielectric layer 222 are then removed to form several openings 222A (i.e. the second dielectric layer 222 is patterned). The openings 221A are through holes which expose a portion of the membrane 24 below the second dielectric layer 222. In some embodiments, the openings 222A are formed by photolithography and wet or dry etching processes.

Figure 8E:
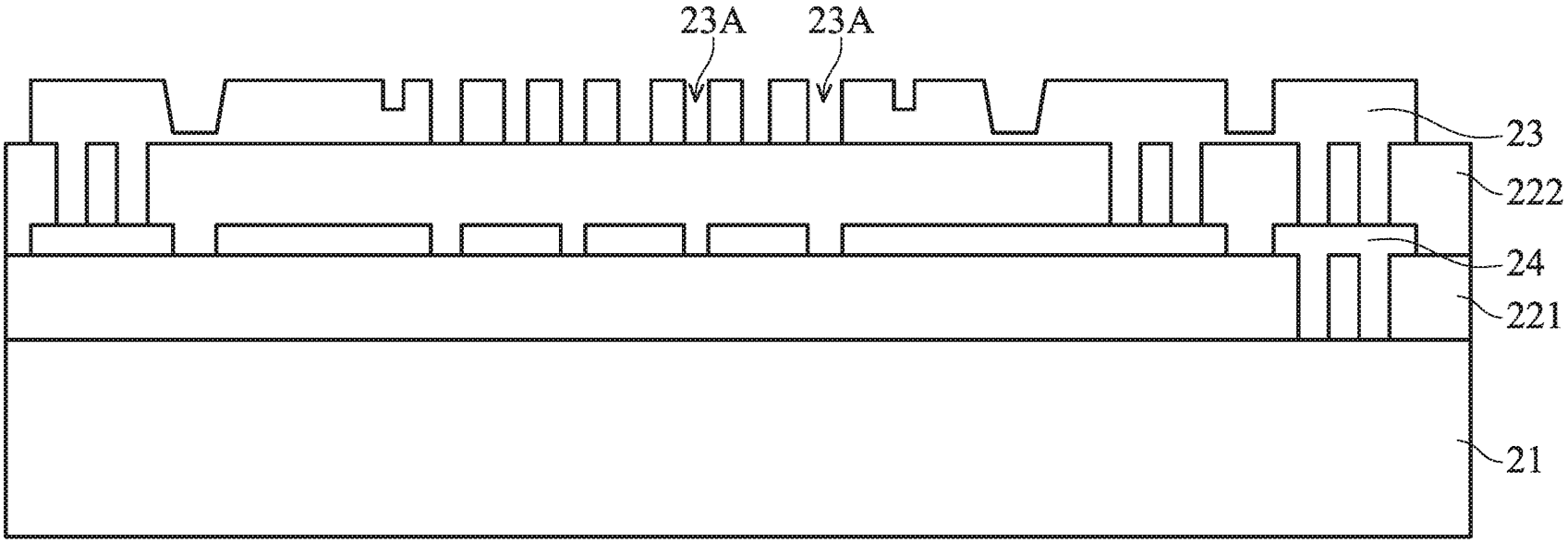
FIG. 8E schematically illustrates an intermediate stage of a method of manufacturing an integrated microphone device, in accordance with some embodiments.

In operation 75, a plate or material layer 23 is disposed over the second dielectric layer 222 as shown in FIG. 8E. The plate 23 is also filled into the openings 222A (FIG. 8D) of the second dielectric layer 222 to connect the membrane 24. In some embodiments, the plate 23 comprises conductively doped poly-silicon. In some embodiments, the plate 23 has a layered structure formed by a nitride/poly-silicon/nitride stacks. In some embodiments, the plate 23 is disposed by any suitable deposition techniques such as CVD and the like. In some embodiments, the plate 23 has a thickness of about 0.5 μm to about 2 μm. Some portions of the plate 23 are then removed to form the vent holes 23A described above (i.e. the plate 23 is patterned). The vent holes 23A expose a portion of the second dielectric layer 222 below the plate 23. In some embodiments, the vent holes 23A are formed by photolithography and wet or dry etching processes.

Figure 8F:
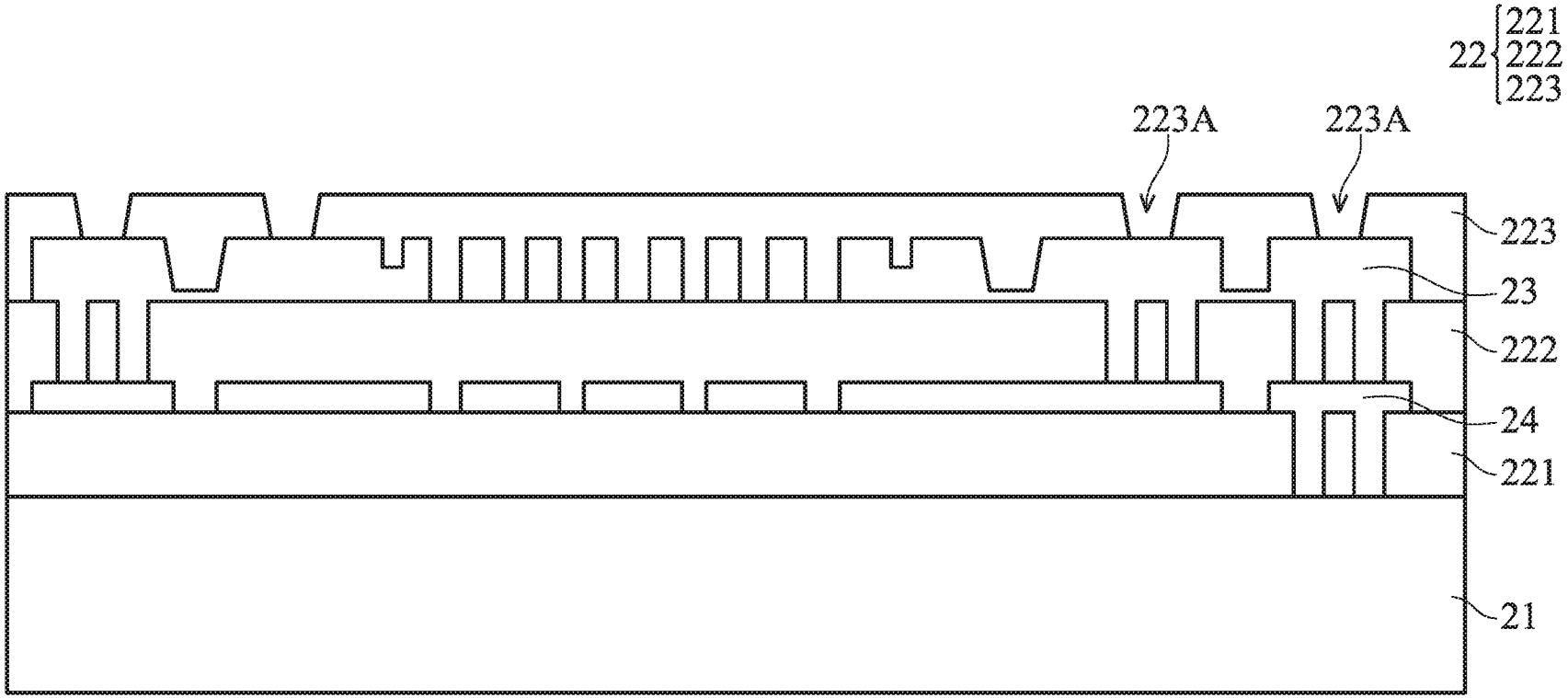
FIG. 8F schematically illustrates an intermediate stage of a method of manufacturing an integrated microphone device, in accordance with some embodiments.

In operation 76, a third dielectric layer 223 is disposed over the second dielectric layer 222 and plate 23 as shown in FIG. 8F. In some embodiments, the third dielectric layer 223 is disposed by any suitable deposition techniques such as CVD and the like. In some embodiments, the third dielectric layer 223 comprises the same or different materials as the second dielectric layer 222. In some embodiments, the third dielectric layer 223 comprises dielectric material such as silicon oxide. In some embodiments, the third dielectric layer 223 has a thickness of about 0.3 μm to about 5 μm. Some portions of the third dielectric layer 223 are removed to form several openings 223A (i.e. the third dielectric layer 223 is patterned). The openings 223A are through holes which expose a portion of the plate 23 below the third dielectric layer 223. In some embodiments, the openings 223A are formed by photolithography and wet or dry etching processes. The first dielectric layer 221, second dielectric layer 222 and third dielectric layer 223 form the dielectric layer 22 of the MEMS structure 20 (FIG. 1).

Figure 8G:
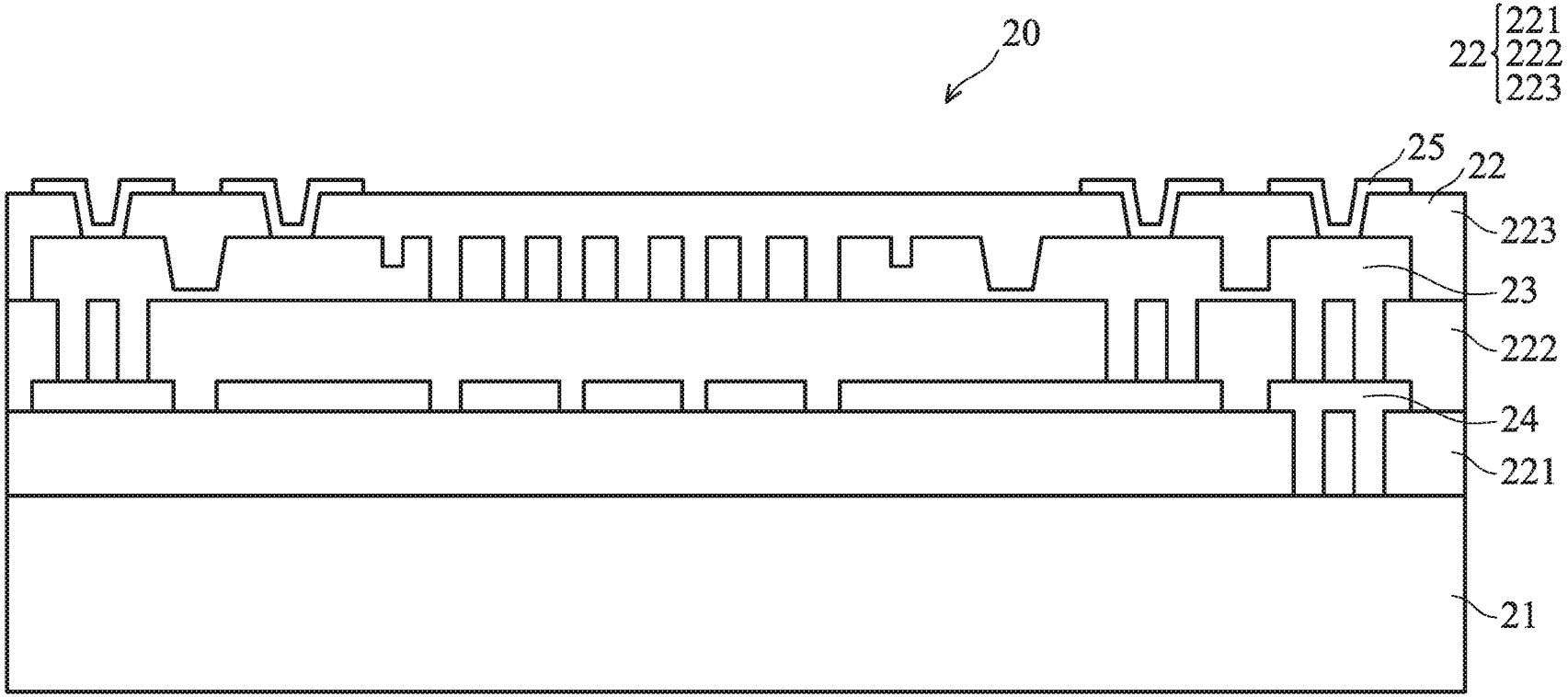
FIG. 8G schematically illustrates an intermediate stage of a method of manufacturing an integrated microphone device, in accordance with some embodiments.

In operation 77, a conductive layer 25 is disposed over the third dielectric layer 223 as shown in FIG. 8G. The conductive layer 25 is also filled into the openings 223A (FIG. 8F) of the third dielectric layer 223 to connect the plate 23. In some embodiments, the conductive layer 25 comprises copper, silver, gold, aluminum, or alloy thereof. In some embodiments, the conductive layer 25 is disposed by any suitable deposition techniques such as CVD and the like. In some embodiments, the conductive layer 25 has a thickness of about 0.5 μm to about 20 μm. Some portions of the conductive layer 25 are then removed to form several conductive pads on the third dielectric layer 223. The conductive pads are formed by photolithography and wet or dry etching processes.

Figure 8H:
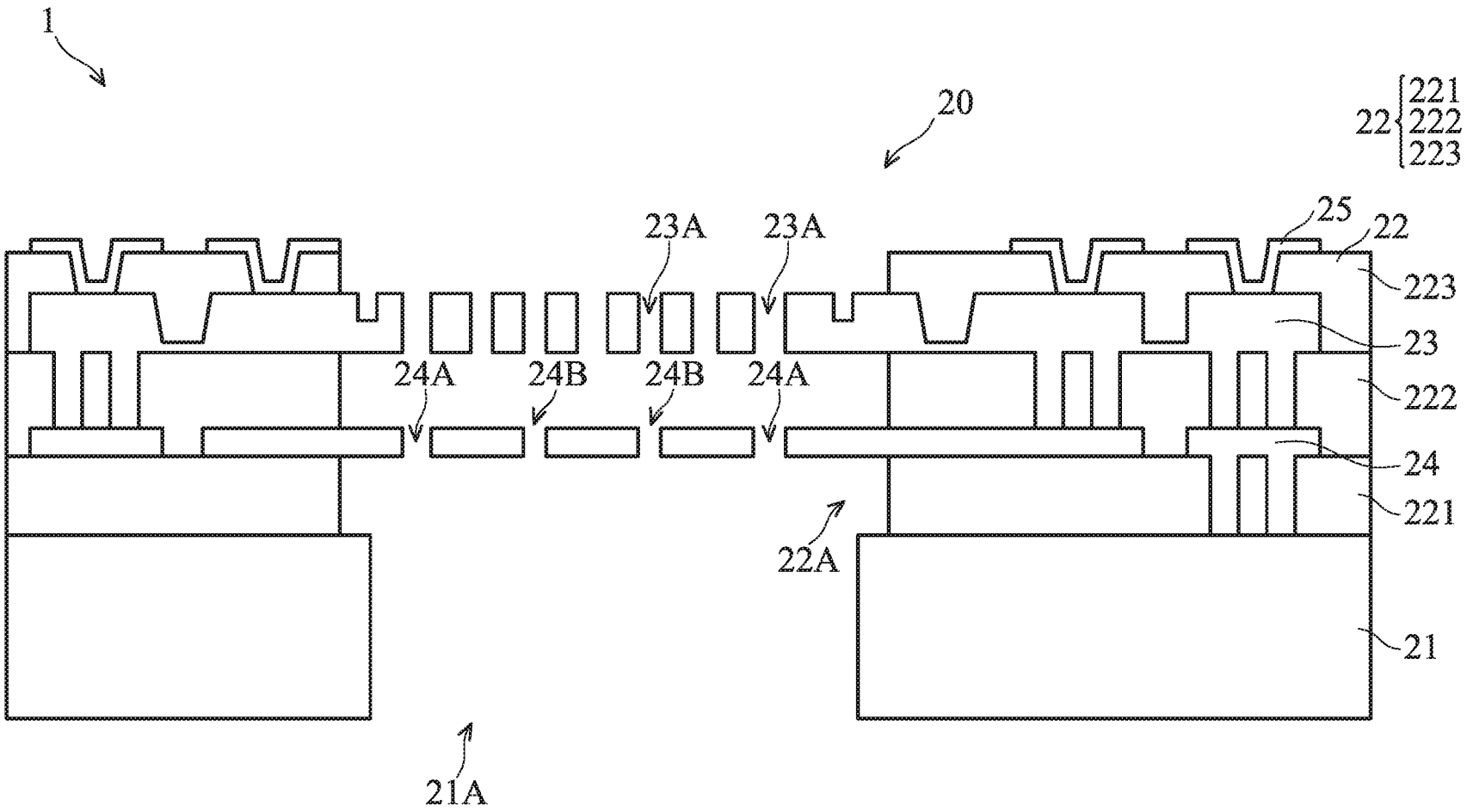
FIG. 8H schematically illustrates an intermediate stage of a method of manufacturing an integrated microphone device, in accordance with some embodiments.

In operation 78, the dielectric layer 22 is partially removed to form the aperture 22A as shown in FIG. 8H (also see FIG. 1), thereby releasing the plate 23 and membrane 24. In some embodiments, hydrofluoric acid (HF) or buffered oxide etch (BOE) wet bench is used to selectively etch the dielectric layer 22 to have the aperture 22A. Although not shown, a protection layer may be used to protect the conductive layer 25 during the etching process. In operation 78, the substrate 21 is also partially removed to form the aperture 21A as shown in FIG. 8H (also see FIG. 1). The aperture 21A may be aligned with the aperture 22A, to allow the acoustic pressure to pass through the MEMS structure 20. In some embodiments, the aperture 21A is formed by photolithography and wet or dry etching (e.g., deep reactive-ion etching (RIE)) processes. As a result, an integrated microphone device 1 as shown in FIG. 1 is completed.

In some embodiments, an integrated microphone device is provided. The integrated microphone device includes a substrate, a plate, and a membrane. The substrate includes an aperture allowing acoustic pressure to pass through. The plate is disposed on a side of the substrate. The membrane is disposed between the substrate and the plate and movable relative to the plate as acoustic pressure strikes the membrane. The membrane includes a vent valve having an open area that is variable in response to a change in acoustic pressure.

In some embodiments, an integrated microphone device is provided. The integrated microphone device includes a plate, a membrane, and a vent valve. The membrane is disposed opposite to the plate and movable relative to the plate as acoustic pressure strikes the membrane. The membrane has a vent hole configured to relieve the stress on the membrane caused by acoustic pressure. The vent valve is formed in the membrane and has an open area that is variable in response to a change in acoustic pressure.

In some embodiments, an integrated microphone device is provided. The integrated microphone device method includes a plate, a membrane, and a vent valve. The membrane is disposed opposite to the plate and movable relative to the plate as acoustic pressure strikes the membrane. The vent valve is formed in the membrane and having an opening and a deflection part. The deflection part covers a portion of the opening and is deflectable relative to the main body of the membrane to change an open area of the opening.

Although embodiments of the present disclosure and their advantages have been described in detail, it should be understood that various changes, substitutions and alterations can be made herein without departing from the spirit and scope of the disclosure as defined by the appended claims. For example, it will be readily understood by those skilled in the art that many of the features, functions, processes, and materials described herein may be varied while remaining within the scope of the present disclosure. Moreover, the scope of the present application is not intended to be limited to the particular embodiments of the process, machine, manufacture, composition of matter, means, methods and steps described in the specification. As one of ordinary skill in the art will readily appreciate from the disclosure of the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps. In addition, each claim constitutes a separate embodiment, and the combination of various claims and embodiments are within the scope of the disclosure.

What is claimed is:

1. An integrated microphone device, comprising:

a plate;

a membrane disposed opposite to the plate and movable relative to the plate as acoustic pressure strikes the membrane; and a vent valve formed in the membrane, wherein the vent valve has a plurality of deflection parts each being deflectable relative to the membrane in order to change an open area of an opening, wherein the deflection parts are disposed around a center of the opening, and one side of each of the deflection parts facing the center is curved, wherein each of the deflection parts is symmetrical with respect to a center line extending from the center of the opening to a center of the respective deflection part, and wherein the opening further includes a plurality of channel portions, and each of the channel portions is disposed between two adjacent deflection parts of the plurality of deflection parts.

2. The integrated microphone device as claimed in claim 1, wherein the vent valve has a first open area in response to a first acoustic pressure and a second open area in response to a second acoustic pressure, wherein the second acoustic pressure is greater than the first acoustic pressure and the second open area is greater than the first open area.

3. The integrated microphone device as claimed in claim 1, wherein an initial open area of the vent valve is less than 20 percent of an area of the membrane.

4. The integrated microphone device as claimed in claim 1, wherein the opening defines a first open area in response to a first deflection of the deflection parts and a second open area in response to a second deflection of the deflection parts, wherein the second deflection is greater than the first deflection and the second open area is greater than the first open area.

5. The integrated microphone device as claimed in claim 1, wherein each of the deflection parts is a beam element with one end connected to a main body of the membrane.

6. The integrated microphone device as claimed in claim 5, wherein a free end portion of the beam element has a smaller width than other portions of the beam element.

7. The integrated microphone device as claimed in claim 1, wherein the side of each of the deflection parts facing the center is concave.

8. The integrated microphone device as claimed in claim 1, wherein the side of each of the deflection parts facing the center is convex.

9. The integrated microphone device as claimed in claim 1, wherein the shape of the opening conforms to the shape of the deflection parts.

10. An integrated microphone device, comprising:

a plate;

a membrane disposed opposite to the plate and movable relative to the plate as acoustic pressure strikes the membrane; and a vent valve formed in the membrane, wherein the vent valve has a plurality of deflection parts each being deflectable relative to the membrane in order to change an open area of an opening, wherein the deflection parts comprise a plurality of first deflection parts and a plurality of second deflection parts arranged alternately around a center of the opening, and the first deflection parts each have a shape different from that of each of the second deflection parts, wherein the opening further includes a plurality of channel portions, and each of the channel portions is disposed between one first deflection part of the plurality of first deflection parts and one second deflection part of the plurality of second deflection parts that is adjacent to the first deflection part, so that the adjacent first and second deflection parts are disconnected.

11. The integrated microphone device as claimed in claim 10, wherein in a radial direction parallel to the membrane, the first deflection parts each have a length different from that of each of the second deflection parts.

12. The integrated microphone device as claimed in claim 11, wherein the first deflection parts are closer to the center of the opening than the second deflection parts.

13. The integrated microphone device as claimed in claim 10, wherein the first deflection parts are deflectable relative to the membrane in response to a first acoustic pressure, and the second deflection parts are deflectable relative to the membrane in response to a second acoustic pressure different from the first acoustic pressure.

14. The integrated microphone device as claimed in claim 10, wherein the shape of the opening conforms to the shape of the deflection parts.

15. The integrated microphone device as claimed in claim 10, further comprising at least one vent hole formed in the membrane and configured to relieve stress on the membrane caused by acoustic pressure, wherein a sum of an initial open area of the vent valve and an open area of the at least one vent hole is less than 20 percent of an area of the membrane.

16. The integrated microphone device as claimed in claim 15, wherein the shape of the vent valve is different from that of the vent hole.

17. The integrated microphone device as claimed in claim 15, wherein the vent valve is closer to a center of the membrane than the vent hole.

18. The integrated microphone device as claimed in claim 10, further comprising:

a substrate including an aperture allowing acoustic pressure to pass through, wherein the plate and the membrane are disposed on a side of the substrate; and a dielectric layer disposed on the side of the substrate and around the plate and the membrane.

19. An integrated microphone device, comprising:

a plate;

a membrane disposed opposite to the plate and movable relative to the plate as acoustic pressure strikes the membrane; and a vent valve formed in the membrane, wherein the vent valve has a plurality of deflection parts each being deflectable relative to the membrane in order to change an open area of an opening, wherein the deflection parts are disposed around a center of the opening, and one side of each of the deflection parts facing the center is curved, wherein the deflection parts have a same shape, and no opening is formed on each of the deflection parts, and wherein the opening further includes a plurality of channel portions, and each of the channel portions is disposed between two adjacent deflection parts of the plurality of deflection parts.

20. The integrated microphone device as claimed in claim 10, wherein one first deflection part of the plurality of first deflection parts is disposed between two second deflection parts of the plurality of second deflection parts, and one second deflection part of the plurality of second deflection parts is disposed between two first deflection parts of the plurality of first deflection parts.

* * * * *